US007178939B2

(12) United States Patent
Tsai

(10) Patent No.: US 7,178,939 B2
(45) Date of Patent: Feb. 20, 2007

(54) ELECTRONIC SIMULATION CANDLE

(75) Inventor: Ching-Tien Tsai, Changhua Hsien (TW)

(73) Assignee: Hsinn Inn Enterprise Co., Ltd., Er Lin Town (TW)

( * ) Notice: Subject to any disclaimer, the term of this patent is extended or adjusted under 35 U.S.C. 154(b) by 20 days.

(21) Appl. No.: 11/176,556

(22) Filed: Jul. 7, 2005

(65) Prior Publication Data

US 2006/0109666 A1 May 25, 2006

(30) Foreign Application Priority Data

Nov. 24, 2004 (TW) ..... 93218860 U

(51) Int. Cl.
*F21L 4/02* (2006.01)

(52) U.S. Cl. ..... 362/190; 362/392; 362/204; 362/206

(58) Field of Classification Search ..... 362/190, 362/800, 200, 202, 205, 206, 208, 392, 203, 362/204, 447
See application file for complete search history.

(56) References Cited

U.S. PATENT DOCUMENTS

2006/0120080 A1* 6/2006 Sipinski et al. ..... 362/253

* cited by examiner

*Primary Examiner*—Sandra O'Shea
*Assistant Examiner*—Sharon Payne
(74) *Attorney, Agent, or Firm*—Alan D. Kamrath; Nikolai & Mersereau, P.A.

(57) ABSTRACT

An electronic simulation candle includes a housing, a lamp shade, a battery box, a circuit board, and a bottom cover. Thus, the electronic simulation candle is operated lively and safely so as to replace the traditional candle. In addition, the lamp shade has a candle flame shape and the two light emitting members light or blink in a special manner to simulate the lighting state of a real candle, thereby enhancing the aesthetic quality of the electronic simulation candle.

17 Claims, 5 Drawing Sheets

ELECTRONIC SIMULATION CANDLE

BACKGROUND OF THE INVENTION

1. Field of the Invention

The present invention relates to an electronic simulation candle, and more particularly to an electronic simulation candle that is operated lively and safely so as to replace the traditional candle.

2. Description of the Related Art

A conventional electronic candle has the shape and pattern of a candle so as to replace the traditional candle. The electronic candle has an inside provided with light emitting member emitting light outward to enhance the outer appearance of the electronic candle. However, the conventional electronic candle cannot provide a lively effect to attract people's attention, thereby limiting the versatility of the conventional electronic candle.

SUMMARY OF THE INVENTION

In accordance with the present invention, there is provided an electronic simulation candle, comprising, a housing, a lamp shade secured on the housing, a battery box mounted in the housing and including a circular plate having a mediate portion formed with a hollow portion, an annular frame mounted on a bottom face of the plate, and two spaced fixing pieces mounted on the bottom face of the plate, a circuit board fixed on the battery box and having a first side provided with two light emitting members mounted in the lamp shade and a second side provided with a power switch extended through the hollow portion of the battery box and located between the fixing pieces of the battery box, a conducting spring extended through the hollow portion of the battery box into the frame of the battery box, and a conducting elastic plate extended through the hollow portion of the battery box into the frame of the battery box, and a battery mounted in the frame of the battery box and rested on the conducting spring and the conducting elastic plate.

The primary objective of the present invention is to provide an electronic simulation candle that is operated lively and safely so as to replace the traditional candle.

Another objective of the present invention is to provide an electronic simulation candle, wherein the lamp shade has a candle flame shape and the two light emitting members light or blink in a special manner to simulate the lighting state of a real candle, thereby enhancing the aesthetic quality of the electronic simulation candle.

A further objective of the present invention is to provide an electronic simulation candle that has a simplified construction, thereby decreasing costs of fabrication.

A further objective of the present invention is to provide an electronic simulation candle that has a smaller volume, thereby facilitating storage, package and transportation.

Further benefits and advantages of the present invention will become apparent after a careful reading of the detailed description with appropriate reference to the accompanying drawings.

DETAILED DESCRIPTION OF THE INVENTION

Figure 1:
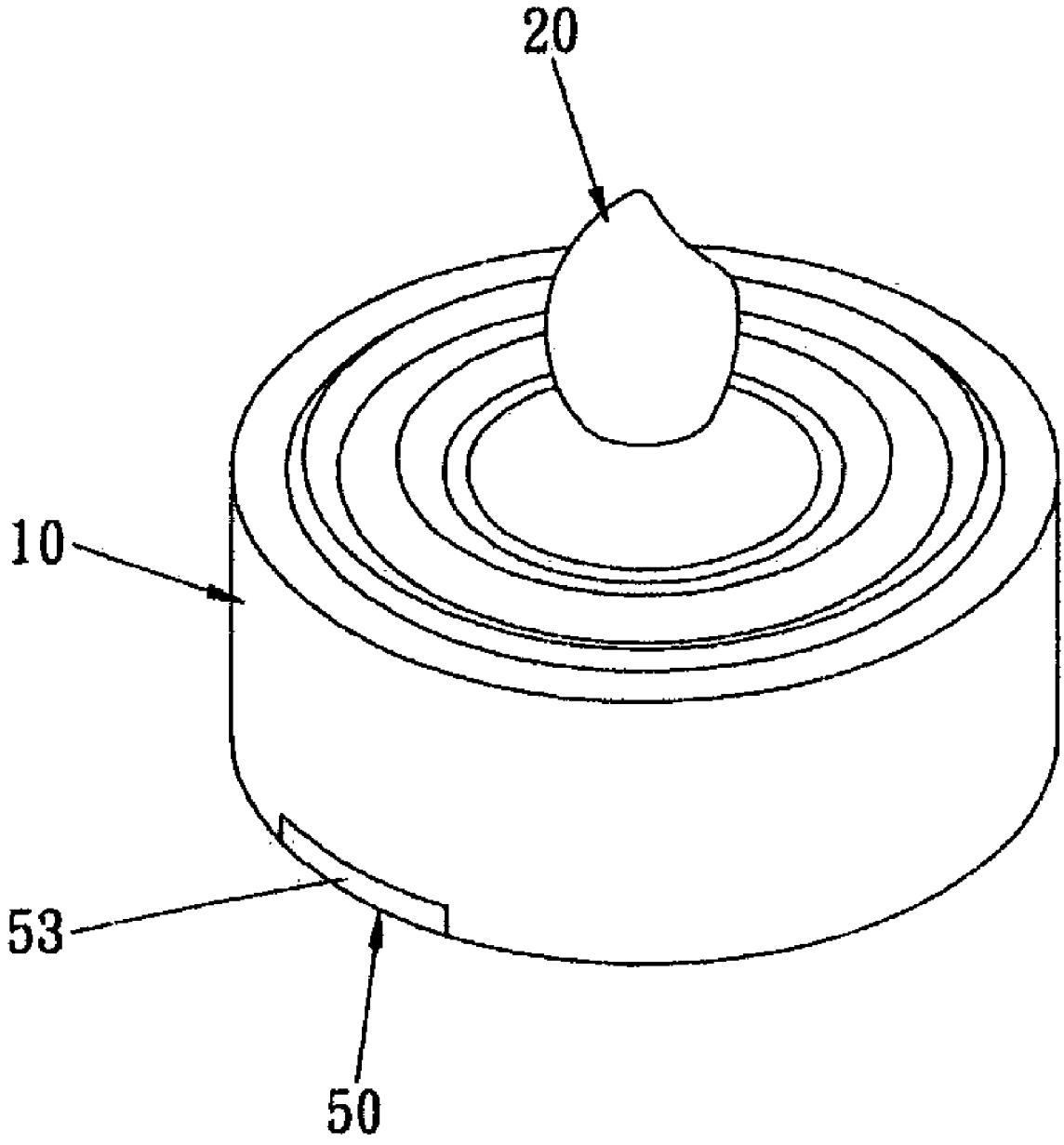
FIG. 1 is a perspective view of an electronic simulation candle in accordance with the preferred embodiment of the present invention.
Figure 2:
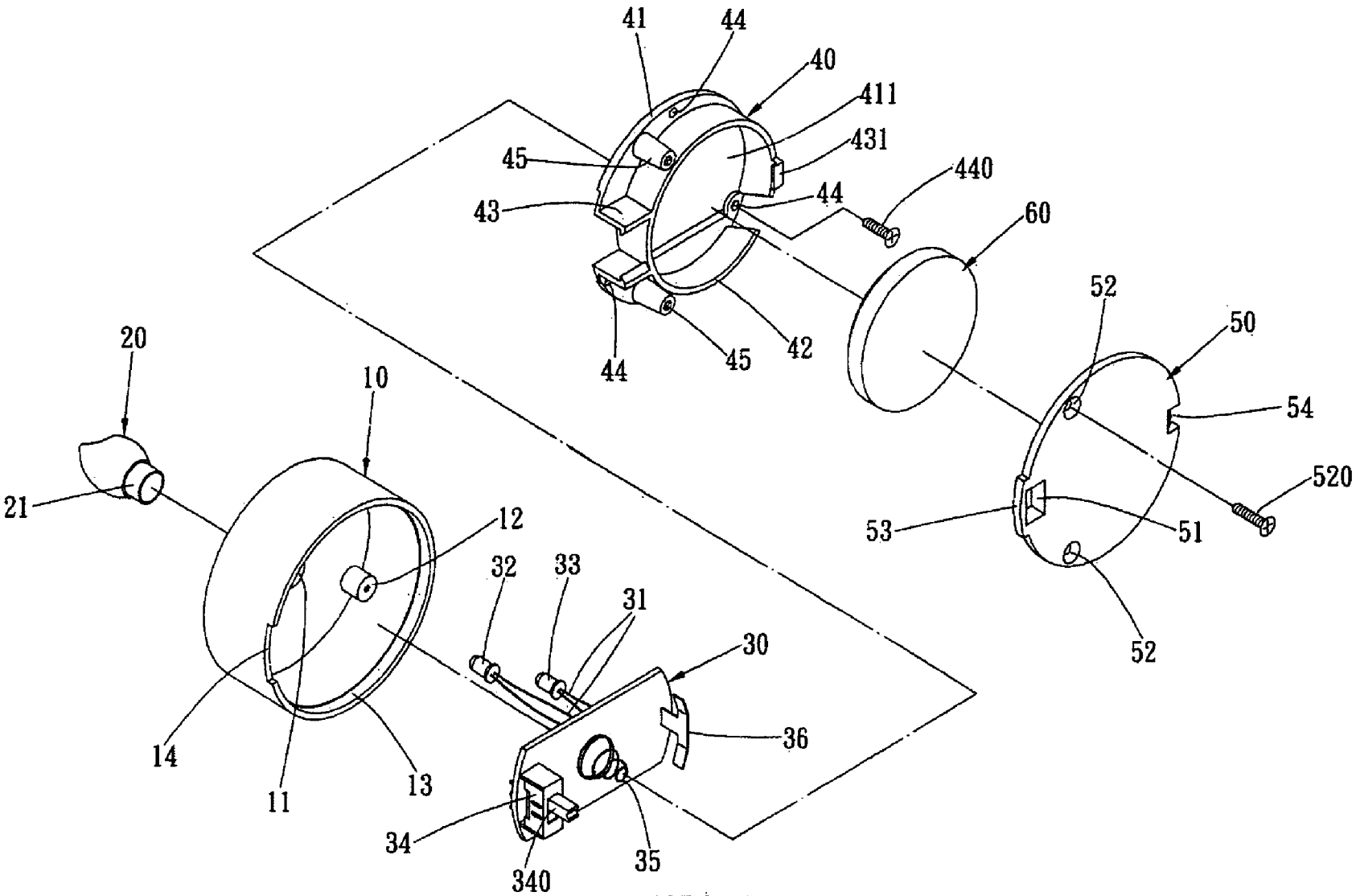
FIG. 2 is an exploded perspective view of the electronic simulation candle as shown in FIG. 1.
Figure 3:
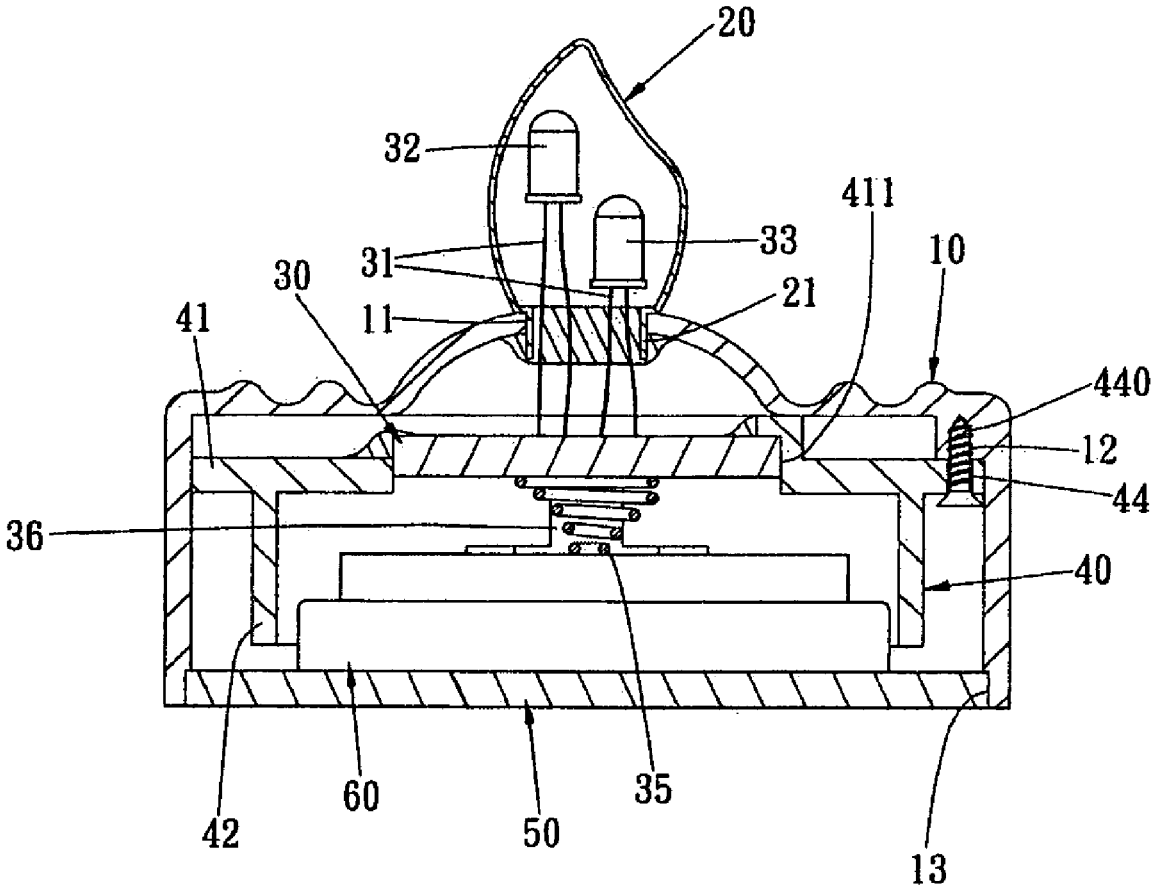
FIG. 3 is a plan cross-sectional view of the electronic simulation candle as shown in FIG. 1.

Referring to the drawings and initially to FIGS. 1–3, an electronic simulation candle in accordance with the preferred embodiment of the present invention comprises a housing 10, a lamp shade 20, a battery box 40, a circuit board 30, and a bottom cover 50.

The housing 10 has a candle shape and has a top face formed with a through hole 11, an inside provided with a plurality of threaded studs 12 and an opened bottom having an inner wall formed with an annular groove 13 and a periphery formed with a positioning depression 14.

The lamp shade 20 has a candle flame shape. The lamp shade 20 is secured on the top face of the housing 10 by bonding and has a lower end formed with a reduced mounting portion 21 inserted into the through hole 11 of the housing 10.

The battery box 40 is mounted in the housing 10 and includes a circular plate 41 having a mediate portion formed with a hollow portion 411 and a periphery formed with a plurality of fixing holes 44 secured to the threaded studs 12 of the housing 10 by screws 440, an annular frame 42 mounted on a bottom face of the plate 41, two spaced fixing pieces 43 mounted on the bottom face of the plate 41, and a plurality of threaded posts 45 mounted on the periphery of the plate 41. The frame 42 has a periphery formed with a positioning lug 431.

The circuit board 30 is fixed on the battery box 40 by bonding and located in the housing 10. The circuit board 30 has a first side provided with two light emitting members 32 and 33 mounted in the lamp shade 20 and a second side provided with a power switch 34 extended through the hollow portion 411 of the battery box 40 and located between the fixing pieces 43 of the battery box 40, a conducting spring 35 extended through the hollow portion 411 of the battery box 40 into the frame 42 of the battery box 40, and a conducting elastic plate 36 extended through the hollow portion 411 of the battery box 40 into the frame 42 of the battery box 40. The two light emitting members 32 and 33 are located at different height levels and connected to the circuit board 30 by two conducting wires 31. The power switch 34 is controlled in a manual, vibration or optical sensitive manner.

A battery 60 is mounted in the frame 42 of the battery box 40 and rested on the conducting spring 35 and the conducting elastic plate 36.

The bottom cover 50 is mounted in the annular groove 13 of the housing 10 and rested on the battery 60. The bottom cover 50 has a plurality of locking holes 52 secured to the threaded posts 45 of the battery box 40 by screws 520. The bottom cover 50 has a side formed with a conical through hole 51, and the power switch 34 has a drive lever 340 extended through the through hole 51 of the bottom cover 50. The bottom cover 50 has a periphery formed with a positioning protrusion 53 positioned in the positioning depression 14 of the housing 10 and a positioning opening 54 to position the positioning lug 431 of the battery box 40.

Figure 4:
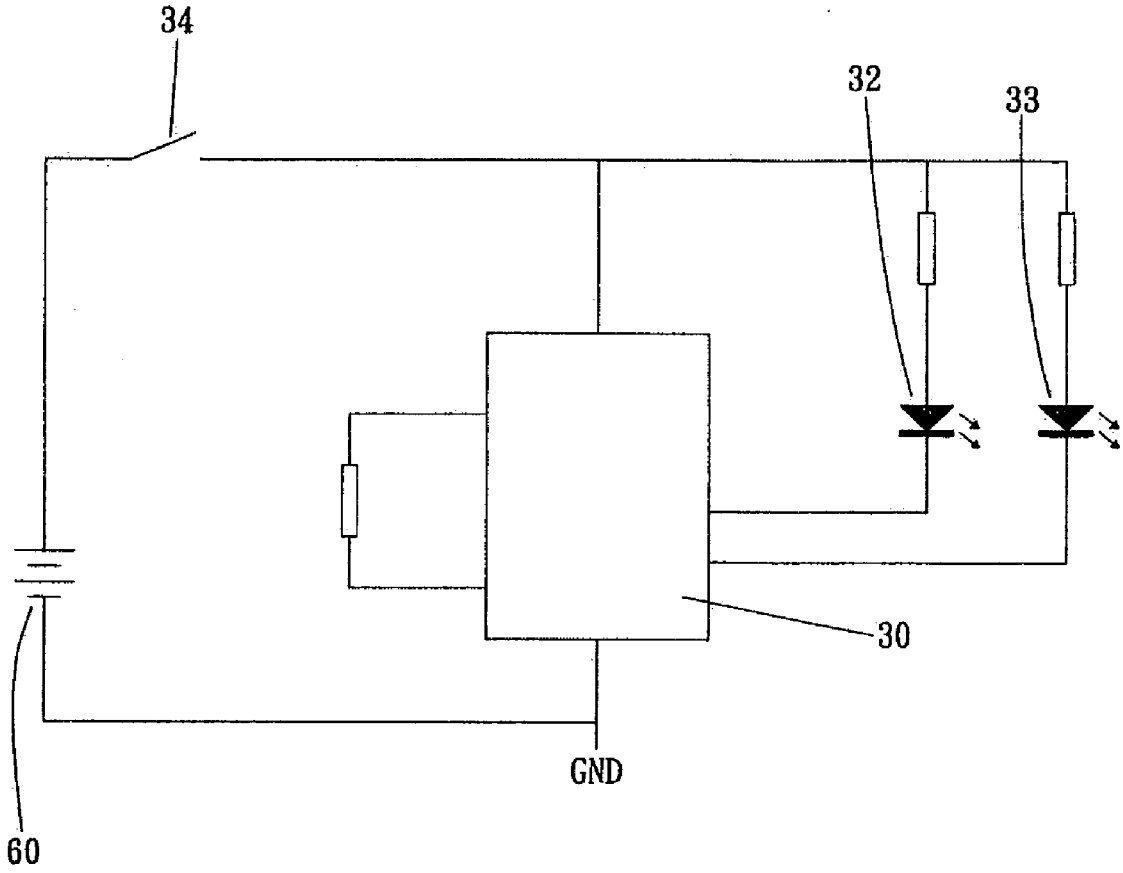
FIG. 4 is a circuit diagram of the electronic simulation candle as shown in FIG. 1.
Figure 5:
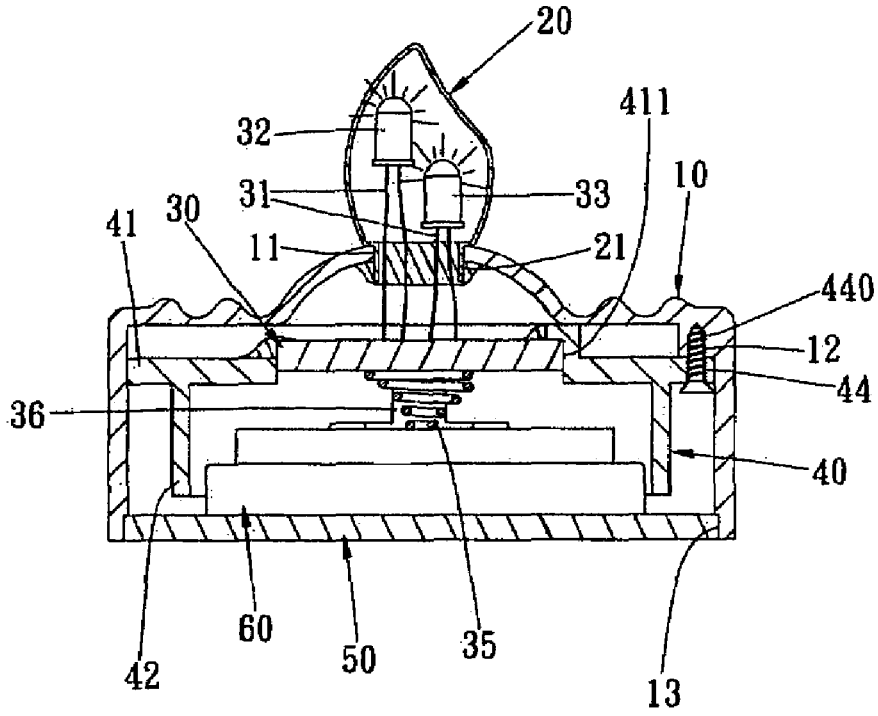
FIG. 5 is a schematic operational view of the electronic simulation candle as shown in FIG. 3 in use.
Figure 6:
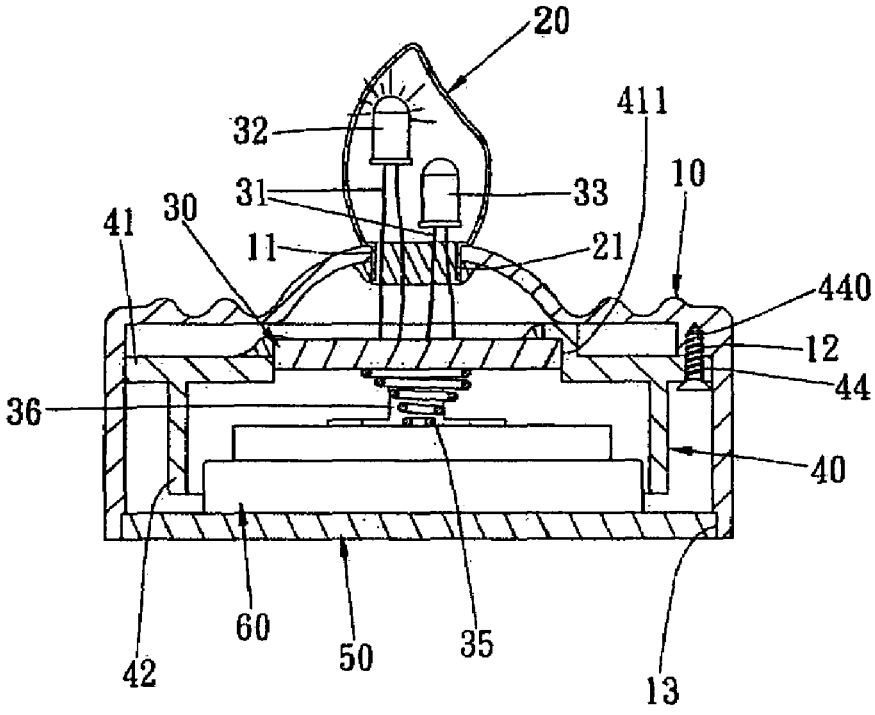
FIG. 6 is a schematic operational view of the electronic simulation candle as shown in FIG. 3 in use.

When in use, referring to FIG. 4-6 with reference to FIGS. 1–3, the drive lever 340 of the power switch 34 is driven to conduct the circuit board 30 with the battery 60 to light the two light emitting members 32 and 33. Thus, the circuit board 30 controls operation of the two light emitting members 32 and 33, so that the two light emitting members 32 and 33 light or blink in a special manner to simulate the lighting state of a real candle.

Accordingly, the electronic simulation candle is operated lively and safely so as to replace the traditional candle. In addition, the lamp shade 20 has a candle flame shape and the two light emitting members 32 and 33 light or blink in a special manner to simulate the lighting state of a real candle, thereby enhancing the aesthetic quality of the electronic simulation candle. Further, the electronic simulation candle has a simplified construction, thereby decreasing costs of fabrication. Further, the electronic simulation candle has a smaller volume, thereby facilitating storage, package and transportation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An electronic simulation candle, comprising:

a housing;

a lamp shade secured on the housing;

a battery box mounted in the housing and including a circular plate having a mediate portion formed with a hollow portion, an annular frame mounted on a bottom face of the plate, and two spaced fixing pieces mounted on the bottom face of the plate;

a circuit board fixed on the battery box and having a first side provided with two light emitting members mounted in the lamp shade and a second side provided with a power switch extended through the hollow portion of the battery box and located between the fixing pieces of the battery box, a conducting spring extended through the hollow portion of the battery box into the frame of the battery box, and a conducting elastic plate extended through the hollow portion of the battery box into the frame of the battery box;

a battery mounted in the frame of the battery box and rested on the conducting spring and the conducting elastic plate.

2. The electronic simulation candle in accordance with claim 1, wherein the housing has a top face formed with a through hole, and the lamp shade has a lower end formed with a reduced mounting portion inserted into the through hole of the housing.

3. The electronic simulation candle in accordance with claim 1, wherein the housing has an inside provided with a plurality of threaded studs, and the circular plate of the battery box has a periphery formed with a plurality of fixing holes secured to the threaded studs of the housing by screws.

4. The electronic simulation candle in accordance with claim 1, wherein the circuit board is fixed on the battery box by bonding.

5. The electronic simulation candle in accordance with claim 1, wherein the circuit board is located in the housing.

6. The electronic simulation candle in accordance with claim 1, wherein the two light emitting members are located at different height levels.

7. The electronic simulation candle in accordance with claim 1, wherein the two light emitting members are connected to the circuit board by two conducting wires.

8. The electronic simulation candle in accordance with claim 1, wherein the power switch is controlled in a manual, vibration or optical sensitive manner.

9. The electronic simulation candle in accordance with claim 1, further comprising a bottom cover mounted in the housing and rested on the battery.

10. The electronic simulation candle in accordance with claim 9, wherein the housing has an opened bottom having an inner wall formed with an annular groove, and the bottom cover is mounted in the annular groove of the housing.

11. The electronic simulation candle in accordance with claim 9, wherein the battery box further includes a plurality of threaded posts mounted on the periphery of the plate, and the bottom cover has a plurality of locking holes secured to the threaded posts of the battery box by screws.

12. The electronic simulation candle in accordance with claim 9, wherein the bottom cover has a side formed with a conical through hole, and the power switch has a drive lever extended through the through hole of the bottom cover.

13. The electronic simulation candle in accordance with claim 9, wherein the housing has an opened bottom having a periphery formed with a positioning depression, and the bottom cover has a periphery formed with a positioning protrusion positioned in the positioning depression of the housing.

14. The electronic simulation candle in accordance with claim 9, wherein the frame has a periphery formed with a positioning lug, and the bottom cover has a periphery formed with a positioning opening to position the positioning lug of the battery box.

15. The electronic simulation candle in accordance with claim 1, wherein the housing has a candle shape.

16. The electronic simulation candle in accordance with claim 1, wherein the lamp shade has a candle flame shape.

17. The electronic simulation candle in accordance with claim 1, wherein the lamp shade is secured on the top face of the housing by bonding.

* * * * *